US006449453B1

(12) United States Patent
Motohashi

(10) Patent No.: US 6,449,453 B1
(45) Date of Patent: Sep. 10, 2002

(54) TRANSFER DEVICE AND IMAGE FORMING APPARATUS

(75) Inventor: Toshiaki Motohashi, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/900,046

(22) Filed: Jul. 9, 2001

(30) Foreign Application Priority Data

Jul. 10, 2000 (JP) ..... 2000-207748

(51) Int. Cl.[7] ..... G03G 15/01; G03G 15/16
(52) U.S. Cl. ..... 399/302; 399/308; 399/310
(58) Field of Search ..... 399/302, 308, 399/297, 66, 310

(56) References Cited

U.S. PATENT DOCUMENTS 4,931,839 A * 6/1990 Tompkins et al. ..... 399/302
5,442,428 A 8/1995 Takahashi et al.
5,461,461 A 10/1995 Harasawa et al.
5,599,645 A 2/1997 Tamiya et al.
5,640,645 A 6/1997 Namekata et al.
5,666,622 A 9/1997 Harasawa et al.
5,740,492 A 4/1998 Deki et al.
5,758,226 A 5/1998 Motohashi
5,881,347 A * 3/1999 May et al. ..... 399/302
5,890,030 A 3/1999 Namekata et al.
5,983,060 A 11/1999 Namekata et al.
6,112,038 A * 8/2000 Takahata ..... 399/302
6,134,416 A 10/2000 Tamiya
6,163,661 A 12/2000 Namekata et al.
6,184,910 B1 2/2001 Sasaki et al.
6,192,205 B1 2/2001 Motohashi
6,212,350 B1 * 4/2001 Yamada et al. ..... 399/302

FOREIGN PATENT DOCUMENTS

JP 2000-221804 8/2000

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

A transfer device according to the present invention have a current detector for detecting a value of an upstream current flowing from an intermediate transfer belt into a tension roller, a transfer bias power source for performing control in such a manner as to prevent any further increase in output voltage value even if an output current value becomes lower than a value which should be subjected to a constant-current control in the case where an output signal from the current detector is a signal indicating 3.2 $\mu$A. Consequently, it is possible to suppress the unclearness of the edge of a transfer image caused by the upstream current flowing in a visible image carrying belt upstream of a transfer position such as a nip.

10 Claims, 4 Drawing Sheets

TRANSFER DEVICE AND IMAGE FORMING APPARATUS

FIELD OF THE INVENTION

The present invention relates to a transfer device for transferring a visible image such as a toner image from a visible image carrying belt such as a photosensitive member or an intermediate transfer belt onto a transfer member such as a transfer sheet, and to an image forming apparatus such as a facsimile, a printer or a copying machine provided with the transfer device.

BACKGROUND OF THE INVENTION

FIG. 4 illustrates a conventionally known transfer device of this type. In FIG. 4, a transfer device 100 comprises an intermediate transfer belt 101 serving as a visible image carrying belt, a secondary transfer bias roller 102 serving as a transfer current applying member, a secondary transfer bias power source, not illustrated, for applying a secondary transfer bias to the secondary transfer bias roller 102, a secondary transfer facing roller 103, a drive roller 104, a tension roller 105, a primary transfer bias roller 106 and a primary transfer grounding roller 107.

The intermediate transfer belt 101 is driven to be rotated in a direction indicated by an arrow B via the drive roller 104 while being stretched across the secondary transfer facing roller 103, the drive roller 104, the tension roller 105, the primary transfer bias roller 106 and the primary transfer grounding roller 107. A portion of the intermediate transfer belt 101, positioned between the primary transfer bias roller 106 and the primary transfer grounding roller 107 is urged toward a photosensitive drum 1 in an image forming apparatus via the rollers 106 and 107, to be positively brought into contact with the photosensitive drum 1, and thus, it forms a primary transfer position.

At the primary transfer position, a primary transfer current is applied to the intermediate transfer belt 101 from the primary transfer bias roller 106, thereby forming a primary transfer electric field therebetween. Most of the primary transfer current applied to the intermediate transfer belt 101 is introduced to a ground via the primary transfer grounding roller 107.

The intermediate transfer belt 101 is sandwiched between the secondary transfer bias roller 102 and the secondary transfer facing roller 103, thereby forming a secondary transfer nip as a transfer position. At the secondary transfer nip, a secondary transfer electric field is formed by a secondary transfer bias which has a polarity opposite to that of a toner and is applied from the secondary transfer bias roller 102 to the intermediate transfer belt 101.

The drive roller 104 and the tension roller 105 are brought into contact with the reverse of the intermediate transfer belt 101 downstream and upstream of the secondary transfer nip (hereinafter referred simply to as a nip downstream side and a nip upstream side, respectively), respectively, and thus, introduce a residual electric charge on the intermediate transfer belt 101 to grounds.

A toner image formed on the photosensitive drum 1 is primarily transferred onto the intermediate transfer belt 101 by the effect of the primary transfer electric field or the like when the intermediate transfer belt 101 passes through the primary transfer position as it is driven to be rotated. The intermediate transfer belt 101 having the primarily transferred toner image formed thereon intrudes in the secondary transfer nip as the intermediate transfer belt 101 is transported.

In the meantime, a sheet feeder, not shown, in the image forming apparatus feeds a transfer sheet 10 toward the secondary transfer nip at such a timing that the toner image is superimposed on the transfer sheet 10. The toner image superimposed on the transfer sheet 10 at the secondary transfer nip is secondarily transferred from the intermediate transfer belt 101 onto the transfer sheet 10 by the effect of a nip inner pressure, the secondary transfer electric field or the like.

In the transfer device 100 such configured as described above, in the case where the secondary transfer bias power source is of a type for applying the secondary transfer bias of a predetermined voltage to the secondary transfer bias roller 102, the secondary transfer current flowing from the secondary transfer bias roller 102 to the intermediate transfer belt 101 is undesirably varied when the electric resistance of the intermediate transfer belt 101 is varied according to environmental fluctuations. In this case, if the secondary transfer current is varied, secondary transfer performance becomes unstable, so that a secondary transfer image of a stable quality cannot be obtained.

Therefore, there are generally used secondary transfer bias power sources of a type for making constant the secondary transfer current from the secondary transfer bias roller 102 to the intermediate transfer belt 101 by a constant current control or the like. Such a secondary transfer bias power source can apply a constant secondary transfer current to the intermediate transfer belt 101 irrespective of the fluctuations in electric resistance of the intermediate transfer belt 101, so as to stabilize the secondary transfer performance.

However, in the transfer device 100 illustrated in FIG. 4, even if the secondary transfer performance is stabilized by applying the constant secondary transfer current to the intermediate transfer belt 101, the edge of the secondary transfer image secondarily transferred onto the transfer sheet 10 may often become unclear depending upon the environment of temperature or humidity.

The present inventor has earnestly studied on causes which make the edge of the secondary transfer image unclear. As a result, he or she has found a phenomenon as follows: the secondary transfer current flowing from the secondary transfer bias roller 102 to the intermediate transfer belt 101 is divided into a downstream current A1 which is transmitted downstream of the nip inside the belt so as to flow in the drive roller 104, a nip current A2 which is transmitted in a belt thickness direction inside the nip so as to flow in the secondary transfer facing roller 103, and an upstream current A3 which is transmitted upstream of the nip inside the belt so as to flow in the tension roller 105, as shown in FIG. 5. It has been found that among these currents, the upstream current A3 disperses some of innumerous toners forming the toner image on the intermediate transfer belt 101 before intruding into the secondary transfer nip from an image portion to the surroundings of a non-image portion, thereby generating toner dispersion.

A downstream resistance R1, a nip resistance R2 and an upstream resistance R3 act on the downstream current A1, the nip current A2 and the upstream current A3, respectively. As illustrated in FIG. 6, the downstream resistance R1 is equivalent to the sum of an electric resistance over a length L1 from the secondary transfer nip of the intermediate transfer belt 101 to a contact position with the drive roller 104 and an electric resistance of the drive roller 104; the nip resistance R2 is equivalent to the sum of an electric resistance of the intermediate transfer belt 101 in a thickness direction and an electric resistance of the secondary transfer facing roller 103; and the upstream resistance R3 is equivalent to the sum of an electric resistance over a length L2 from the secondary transfer nip of the intermediate transfer belt 101 to a contact position with the tension roller 105 and an electric resistance of the tension roller 105.

The reason why unclearness of the edge is found or not depending upon the environment is as follows. Namely, variations in electric resistance according to the environmental fluctuations are generated in not only the intermediate transfer belt but also the secondary transfer facing roller 103, the drive roller 104 or the tension roller 105. If at least one of these rollers is varied in electric resistance at a varying rate different from those of the other rollers, a rate occupied by the upstream resistance R3 is varied with respect to the entire resistance R0 which is the sum of the electric resistances R1 to R3. If the environment is changed so as to reduce the rate, the upstream current A3 is naturally increased. When the increase reaches a predetermined value, the toner dispersion adversely proceeds to such an extent as to be visually recognized with ease, and consequently, the dispersed toner is secondarily transferred together with the toner image at the secondary transfer nip, thereby making the edge of the secondary transfer image unclear.

Incidentally, although the description has been given of the transfer device for applying the secondary transfer bias having the polarity opposite to that of the toner to the transfer surface of the intermediate transfer belt 101 in reference to FIGS. 4 to 6, similar toner dispersion may possibly occur also in a transfer device for applying a secondary transfer bias having the same polarity as that of the toner to the reverse of the intermediate transfer belt 110. Not only in the transfer device in which each of the drive roller 104 and the tension roller 105 is grounded but also in a transfer device in which only the tension roller 105 upstream of the nip is grounded, similar toner dispersion may possibly occur if the electric resistances of the secondary transfer facing roller 103 and the tension roller 105 are varied at different varying rates. Moreover, similar toner dispersion may possibly occur not in the transfer device in which the secondary transfer nip is formed but in a transfer device in which a transfer position forming roller in place of the secondary transfer facing roller 103 forms a secondary transfer position in contact with the intermediate transfer belt 101 at a position not facing to the secondary transfer bias roller 102. Additionally, although the explanation has been made on the toner dispersion which may possibly occur when the toner image is secondarily transferred from the intermediate transfer belt 101 onto the transfer sheet 10, similar toner dispersion may possibly occur also when a visible image is transferred from the visible image carrying belt onto the transfer member, for example, when the visible image is primarily transferred from the photosensitive belt onto the transfer member such as the transfer sheet.

SUMMARY OF THE INVENTION

It is an object of the present invention to provide a transfer device capable of suppressing unclearness of the edge of a transfer image, caused by an upstream current flowing in a visible image carrying belt upstream of a transfer position such as a nip, and an image forming apparatus provided with the transfer device.

A transfer device according to a first aspect of the present invention comprises a visible image carrying belt carrying a visible image thereon and traveling in a predetermined direction; a transfer current applying member for applying a transfer current in contact with the visible image carrying belt; a transfer position forming member in contact with a surface of the visible image carrying belt on a side opposite to the surface in contact with the transfer current applying member, for introducing a transfer current in a direction of the thickness of the visible image carrying belt so as to form a transfer position between the transfer current applying member and the same; a downstream grounding member disposed in such a manner as to be brought into contact with the visible image carrying belt downstream of the transfer position in the predetermined direction, to be thus electrically grounded; and an upstream grounding member disposed in such a manner as to be brought into contact with the visible image carrying belt upstream of the transfer position in the predetermined direction, to be thus electrically grounded, wherein a visible image on the visible image carrying belt is transferred onto a transfer member to be fed to the transfer position, and a downstream resistance equivalent to the sum of an electric resistance over a length from a contact position with the transfer current applying member to a contact position with the downstream grounding member on the visible image carrying belt and an electric resistance of the downstream grounding member is set to be lower than an upstream resistance equivalent to the sum of an electric resistance over a length from the contact position with the transfer current applying member to a contact position with the upstream grounding member on the visible image carrying belt and an electric resistance of the downstream grounding member irrespective of environmental fluctuations.

In the transfer device, the downstream resistance is set to be lower than the upstream resistance irrespective of the environmental fluctuations, so that the quantity of the upstream current flowing upstream in the belt transporting direction beyond the transfer position is set to be smaller than the quantity of the downstream current flowing downstream in the belt transporting direction beyond the transfer position. With this configuration, the quantity of the upstream current can be excellently reduced so as to suppress the unclearness of the edge of the transfer image caused by the upstream current in comparison with the case where the downstream resistance is set to be equal to or higher than the upstream resistance.

The present inventor has examined the relationship between the quantity of the upstream current flowing from the secondary transfer nip to the tension roller 105 and the unclearness of the edge of the secondary transfer image by the use of a transfer device similar to the transfer device 100 illustrated in FIG. 4. Concretely, the drive roller 104 and the tension roller 105 were replaced in sequence with rollers capable of exhibiting their specific electric resistances, respectively, and then, the quantity of the upstream current A3 was adjusted at various values while adjusting the ratio of the downstream resistance R1 to the upstream resistance R3. An examination was made of the unclearness of the edge of the secondary transfer image when the upstream current A3 of each of the values flowed. The examination result is shown below in Table 1.

TABLE 1

| Secondary transfer current (μA) | NIP current A2 (μA) | Downstream current A1 (μA) | Upstream current A3 (μA) | Division ratio (A1:A3) | Toner dispersion |
|---|---|---|---|---|---|
| 20 | 12 | 6.0 | 2.0 | 3:1 | ○ |
| | | 5.7 | 2.3 | 2.5:1 | ○ |

TABLE 1-continued

| Secondary transfer current (μA) | NIP current A2 (μA) | Downstream current A1 (μA) | Upstream current A3 (μA) | Division ratio (A1:A3) | Toner dispersion |
|---|---|---|---|---|---|
| | | 5.3 | 2.7 | 2:1 | ○ |
| | | 4.8 | 3.2 | 1.5:1 | ○ |
| | | 4.0 | 4.0 | 1:1 | Δ |
| | | 2.7 | 5.3 | 1:1.5 | X |

In Table 1, "○" designates that no unclearness of the edge was visually recognized; "Δ" designates that the unclearness of the edge was visually recognized in a slight fashion; and "×" designates that the unclearness of the edge was visually recognized with ease. As shown in Table 1, it is found that if the upstream current A3 is set at 3.2 (μA) or lower, the unclearness of the edge of the secondary transfer image caused by the upstream current A3 can be suppressed to such a level as not to be visually recognized.

Thus, a transfer device according to a second aspect of the present invention comprises: a visible image carrying belt carrying a visible image thereon and traveling in a predetermined direction; a transfer current applying member for applying a transfer current in contact with the visible image carrying belt; a transfer position forming member in contact with a surface of the visible image carrying belt on a side opposite to the surface in contact with the transfer current applying member, for introducing a transfer current in a direction of the thickness of the visible image carrying belt so as to form a transfer position between the transfer current applying member and the same; and grounding members in contact with the visible image carrying belt at positions different from that of the transfer position forming member, to be thus electrically grounded, wherein a visible image on the visible image carrying belt is transferred onto a transfer member to be fed to the transfer position, and the quantity of a current flowing upstream of the transfer position in the predetermined direction on the visible image carrying belt with the application of the transfer current is maintained at 3.2 μA or lower irrespective of environmental fluctuations.

In the transfer device, the quantity of the upstream current is maintained at 3.2 μA or lower irrespective of the environmental fluctuations, thereby suppressing the unclearness of the edge of the transfer image caused by the upstream current to such a level as not to be visually recognized.

A transfer device according to a third aspect of the present invention, as related in the second aspect, environmental conditions suitable for use are designated, and the visible image carrying belt, the transfer position forming member and the grounding members each are composed of a material capable of exhibiting resistance varying characteristics in such a manner as to maintain the quantity of the current at 3.2 μA or lower as long as the transfer device is used under the environmental conditions.

In the transfer device, the environmental condition suitable for the use is designated by explicitly describing, for example, the temperature range or humidity range suitable for the use in a seal stuck to the device or an instruction manual. In the meantime, the visible image carrying belt such as an intermediate transfer belt, the transfer position forming member such as a secondary transfer facing roller and the grounding members such as a drive roller and a tension roller can exhibit such resistance varying characteristics as to maintain the quantity of the upstream current at 3.2 μA or lower under the above-described environmental condition. With this configuration, the unclearness of the edge of the transfer image caused by the upstream current can be suppressed to such a level as not to be visually recognized under the designated environmental condition.

A transfer device according to a fourth aspect of the present invention, as related in the second aspect, the visible image carrying belt, the transfer position forming member and the grounding members each are composed of a material capable of exhibiting resistance varying characteristics in such a manner as to maintain the quantity of the current at 3.2 μA or lower within a temperature range from 10° C. or higher to 40° C. or lower irrespective of temperature fluctuations, or within a humidity range from 15% or more to 80% or less irrespective of humidity fluctuations.

In the transfer device, the unclearness of the edge of the transfer image caused by the upstream current can be suppressed to such a level as not to be visually recognized irrespective of the fluctuations in temperature or the fluctuations in humidity within a general function ensuring temperature range (from 10° C. to 40° C.) or a general function ensuring humidity range (from 15% to 80%) in the transfer device.

A transfer device according to a fifth aspect of the present invention, as related in the second aspect, there are provided a transfer power source for supplying the transfer current to the transfer current applying member and current detecting means for detecting the quantity of the current, and the transfer power source is configured such that an output current is controlled in such a manner that the quantity of the current detected by the current detecting means becomes 3.2 μA or lower.

In the transfer device, the quantity of the upstream current is maintained at 3.2 μA or lower by controlling the quantity of the upstream current by means of the transfer voltage power source even unless the respective resistance varying characteristics of the visible image carrying belt, transfer position forming member and grounding members are finely adjusted, so that the unclearness of the edge of the transfer image caused by the upstream current can be suppressed to such a level as not to be visually recognized.

An image forming apparatus according to a sixth aspect of the present invention comprises: visible image forming means for forming a visible image on a visible image carrying belt; and a transfer device for transferring the visible image from the visible image carrying belt onto a transfer member, wherein an image is formed by transferring the visible image onto the transfer member, and the transfer device is according to the first, second, third, fourth or fifth aspect.

In the image forming apparatus, the quantity of the upstream current can be excellently reduced so as to suppress the unclearness of the edge of the transfer image caused by the upstream current by the effect similar to that of the transfer device according to the first aspect in the case where the image forming apparatus is provided with the transfer device according to the first aspect in comparison with the case where the downstream resistance is equal to or higher than the upstream resistance inside the transfer device. Furthermore, the unclearness of the edge of the transfer image caused by the upstream current can be suppressed to such a level as not to be visually recognized irrespective of the environmental fluctuations by the effect similar to that of the transfer device according to the second aspect in the case where the image forming apparatus is provided with the transfer device according to the second, third, fourth or fifth aspect. Other objects and features of this invention will become apparent from the following description with reference to the accompanying drawings.

DESCRIPTION OF THE PREFERRED EMBODIMENTS

Figure 1:
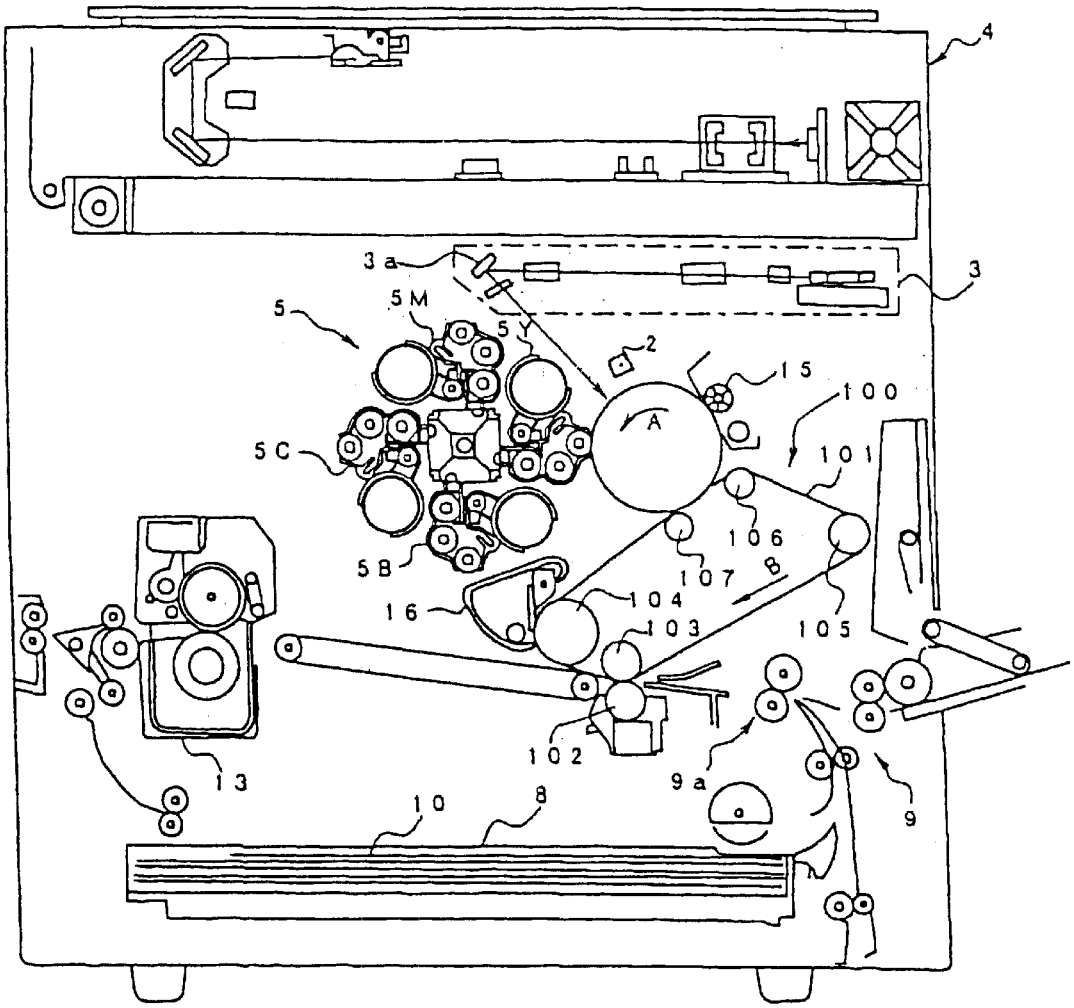
FIG. 1 is a schematic view showing the entire constitution of a copying machine in a first embodiment.

A description will be given below of a full color copying machine of an electrophotographic system (hereinafter referred simply to as "a copying machine") as an image forming apparatus in a first embodiment, to which the present invention is applied. FIG. 1 is a schematic view showing the entire constitution of the copying machine in the first embodiment; and FIG. 2 is a schematic view showing the constitution of the surroundings of a transfer unit in the copying machine of FIG. 1.

Figure 2:
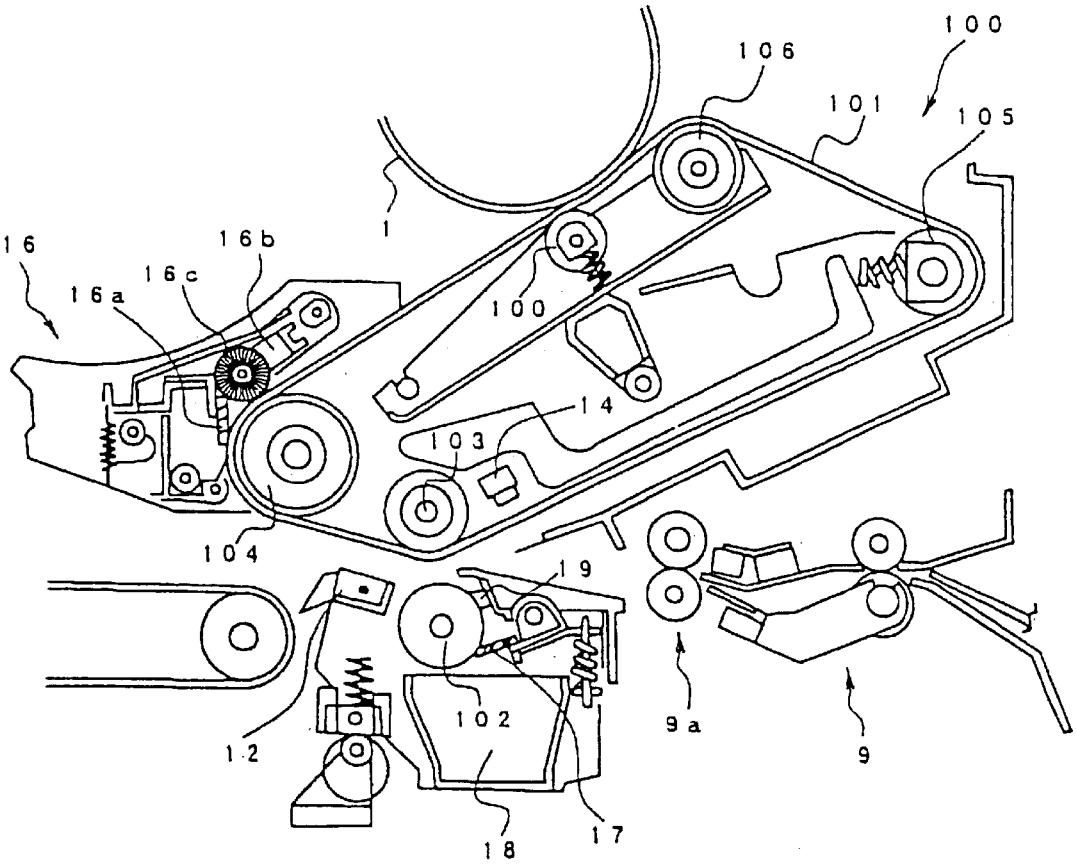
FIG. 2 is a schematic view showing the constitution of the surroundings of a transfer unit in the copying machine of FIG. 1.

Referring to FIGS. 1 and 2, explanation will be first made on the basic constitution of the copying machine in the first embodiment. In each of FIGS. 1 and 2, while a photosensitive drum 1 is driven to be rotated in a direction indicated by an arrow A in FIG. 1, the surface of the drum 1 is electrically charged in a uniform manner by a charger 2 serving as charging means. Thereafter, a laser beam emitted from an optical laser device 3 is introduced in a predetermined direction by a mirror a, to thus scan and expose the drum 1 based on image information, thereby forming an electrostatic latent image.

The above-described image information is image information obtained by proper image processing according to document information read by a scanner 4 serving as image reading means, and further, is monochromatic image information obtained by decomposing a desired full color image into respective pieces of color information of yellow, magenta, cyan and black. The electrostatic latent images based on the image information of each of the colors are formed in sequence on the photosensitive drum 1. The respective electrostatic latent images corresponding to the colors are developed into toner images of yellow, magenta, cyan and black by a yellow developer 5Y, a magenta developer 5M, a cyan developer 5C and a black developer 5B, respectively, which are moved in sequence to a position facing to the photosensitive drum 1 according to the rotation of a rotary type developing device 5.

Under the photosensitive drum 1 in FIGS. 1 and 2 is disposed a transfer device 100 comprising an intermediate transfer belt 101, a secondary transfer bias roller 102, a secondary transfer facing roller 103, a drive roller. 104, a tension roller 105, a primary transfer bias roller 106, a primary grounding roller 107, a not-shown primary transfer bias power source and a not-shown secondary transfer bias power source.

The intermediate transfer belt 101 serving as a visible image carrying belt is driven to be transported in a direction indicated by an arrow B in FIG. 1 in such a manner as to be synchronous with the photosensitive drum 1 as the drive roller 104 is rotated while the intermediate transfer belt 101 is stretched across the five rollers designated by reference numerals 103 to 107. As the intermediate transfer belt 101 is used a belt which is made of a material such as PVdF (polyvinylidene fluoride) having a thickness of 150 $\mu$m and has a volume resistivity of 108 to 1,014Ω·cm (measured at 100 V for 10 sec. by a measuring method described in JIS k6911) and a surface resistivity of 108 to 1,014Ω/□ (measured at 500 V for 10 sec. by a resistivity meter, Hiresta IP, manufactured by Mitsubishi Chemical Corporation). Incidentally, these resistivities are exhibited under the environmental condition that the temperature is 23° C. and the humidity ranges from 50% to 60%.

A portion positioned between the primary transfer bias roller 106 and the primary transfer grounding roller 107 in the intermediate transfer belt 101 is positively brought into close-contact with the photosensitive drum 1 so as to form a primary transfer position. A primary transfer current is applied from the primary transfer bias roller 106 to the intermediate transfer belt 101, so that a primary transfer electric field is formed at the primary transfer position between the primary transfer bias roller 106 and the intermediate transfer belt 101. Most of the primary transfer current applied to the intermediate transfer belt 101 is introduced to a ground via the primary grounding roller 107.

The primary transfer bias power source for supplying a primary transfer bias to the primary transfer bias roller 106 subjects the primary transfer bias to a differential constant-current control disclosed in Japanese Patent Application Laid-Open No. 8-314285, so as to maintain the primary transfer current flowing from the primary transfer bias roller 106 to the intermediate transfer belt 101 at a constant value irrespective of environmental fluctuations.

The secondary transfer facing roller 103 serving as a transfer position forming member abuts against and bites at the secondary transfer bias roller 102 composed of an elastic member while the intermediate transfer belt 101 is held between the secondary transfer facing roller 103 and the secondary transfer bias roller 102, thereby forming a secondary transfer nip as a transfer position. This biting is achieved as follows: when the copying machine in the present embodiment is in a stand-by state, the secondary transfer bias roller 102 is separate from the intermediate transfer belt 101, as shown in FIG. 2. Upon starting of a copying operation, the secondary transfer bias roller 102 is moved upward in FIG. 2 at a predetermined timing by a lifting clutch, to thus abut against the secondary transfer facing roller 103 while the intermediate transfer belt 101 is held between the secondary transfer facing roller 103 and the secondary transfer bias roller 102, so that the secondary transfer bias roller 102 bites at the secondary transfer facing roller 103. The secondary transfer bias roller 102 is kept at a given parallelism with the secondary transfer facing roller 103 by positioning means, not shown. Furthermore, the abutment pressure of the secondary transfer bias roller 102 against the secondary transfer facing roller 103 is constantly kept by a positioning roller, not shown, disposed in the secondary transfer bias roller 102.

At the secondary transfer nip is formed a secondary transfer electric field by the influence of a secondary transfer bias, which has a polarity reverse to that of a toner and is applied from the secondary transfer bias roller 102 serving as a transfer current applying member to the intermediate transfer belt 101.

The secondary transfer bias power source for applying the secondary transfer bias to the secondary transfer bias roller 102 subjects the secondary transfer bias to a constant-current control, so as to maintain the secondary transfer current flowing from the secondary transfer bias roller 102 to the intermediate transfer belt 101 at a constant value.

The drive roller 104 and the tension roller 105 are disposed downstream and upstream of the secondary transfer nip, respectively, and then, are connected to grounds, thereby introducing residual charges remaining on the intermediate transfer belt 101 to the grounds. In this manner, the drive roller 104 and the tension roller 105 exhibit the functions of a downstream grounding member and an upstream grounding member, respectively.

The above-described toner images of the respective colors developed in sequence on the photosensitive drum 1 are primarily transferred in sequence in superimposition on the intermediate transfer belt 101 at the primary transfer position by the effect of the primary transfer electric field for each of the toner images of yellow, magenta, cyan and black. Upon completion of the primary transferring of all of the toner images in superimposition, a full color primary transfer image is formed on the intermediate transfer belt 101.

In this manner, the copying machine in the present embodiment is provided with toner image forming means for forming the full color primary transfer image as a visible image on the intermediate transfer belt 101 as the visible image carrying belt.

The above-described lifting clutch forms the above-described secondary transfer nip by the lifting motion of the secondary transfer bias roller 102 during a period after a three-color transfer image composed of toner images of three colors of yellow, magenta and cyan in superimposition passes through a position facing to the secondary transfer bias roller 102 as the intermediate transfer belt 101 is transported until the full color primary transfer image is moved to the facing position.

In the meantime, a sheet feeding register 9 disposed right ward of the secondary transfer nip in FIGS. 1 and 2 is adapted to feed a transfer sheet 10 as a transfer member from a sheet feeding cassette 8 or a manual tray to a pair of registration rollers 9*a*. The pair of registration rollers 9*a* feed the transfer sheet 10 between the intermediate transfer belt 101 and the secondary transfer bias roller 102 at the above-described secondary transfer nip at such a timing that the transfer sheet 10 is superimposed on the full color primary transfer image.

The full color primary transfer image superimposed on the transfer sheet 10 at the above-described secondary transfer nip is secondarily transferred from the intermediate transfer belt 101 onto the transfer sheet 10 by one operation by the effect of a nip inner pressure or the above-described secondary transfer electric field. The transfer sheet 10, on which a full color secondary transfer image is formed by the secondary transferring, is separated from the intermediate transfer belt 101 by a sheet discharger 12, and then, is fed to a fixing device 13. The full color secondary transfer image is fixed onto the transfer sheet 10 by the fixing device 13, and thereafter, the transfer sheet 10 is discharged outside of the copying machine.

A primary transfer residual toner slightly remaining on the photosensitive drum 1 after the primary transferring onto the intermediate transfer belt 101 is cleaned by a cleaning device 15 for a photosensitive member for the preparation of re-use of the photosensitive drum 1.

Furthermore, a secondary transfer residual toner, which is not secondarily transferred onto the transfer sheet 10 and remains on the intermediate transfer belt 101, is removed from the intermediate transfer belt 101 by a cleaning device 16 for the intermediate transfer belt disposed in such a manner as to be freely brought into or out of contact with the intermediate transfer belt 101. The cleaning device 16 for the intermediate transfer belt includes a cleaning blade 16*a* for removing the residual toner from the intermediate transfer belt 101 in abutment against the intermediate transfer belt 101 and a lubricant applying brush 16*c* for grinding a coating bar 16*b* composed of a lubricant formed into a plate-like shape so as to apply the lubricant onto the intermediate transfer belt 101.

A deposition deposited onto the above-described secondary transfer bias roller 102 is removed by a cleaning blade 17 in abutment against the secondary transfer bias roller 102, and thereafter, is contained inside a sheet transfer recovery case 18. Another coating bar 19 applies a lubricant to the surface of the secondary transfer bias roller 102 after the cleaning.

The copying machine in the present first embodiment is configured in such a manner as to start image forming processing based on a timing when a not-shown position detecting mark formed in a non-image region on the intermediate transfer belt 101 is detected by a belt mark sensor 14. Incidentally, in the case where a monochromatic copy image is formed by the copying machine in the present embodiment, the image forming processing may be started without detecting a position detecting mark by the belt mark sensor 14.

Subsequently, explanation will be made on a configuration peculiar to the copying machine in the present first embodiment.

In the copying machine in the present embodiment, the materials of the drive roller 104, the secondary transfer facing roller 103, the tension roller 105 and the intermediate transfer belt 101 are combined so as to exhibit resistance varying characteristics in such a manner that a downstream resistance R1 securely becomes lower than an upstream resistance R3 under a predetermined condition. The downstream resistance R1 is equivalent to the sum of an electric resistance over a length from the secondary transfer nip to the contact position with the drive roller 104 on the intermediate transfer belt 101 and an electric resistance of the drive roller 104. Furthermore, the upstream resistance R3 is equivalent to the sum of an electric resistance over a length from the secondary transfer nip to the contact position with the tension roller 105 on the intermediate transfer belt 101 and an electric resistance of the tension roller 105. The predetermined condition signifies a condition provided with any of a proper temperature range or a proper humidity range explicitly described in a seal stuck to the machine body or an instruction manual, a temperature range from 10° C. or higher to 40° C. or lower which is a general function ensuring temperature range of the transfer device 100, and a humidity range from 15% or more to 80% or less which is a general function ensuring humidity range of the transfer device 100.

Specifically, in the copying machine in the present embodiment, the drive roller 104 is composed of a material capable of exhibiting an electric resistance remarkably lower than that of a material of the tension roller 105, and further, the length from the secondary transfer nip to the drive roller 104 and the length from the secondary transfer nip to the tension roller 105 are appropriately adjusted, thereby achieving "the downstream resistance R1 lower than the upstream resistance R3" all the time under the predetermined condition.

When the condition of "the downstream resistance R1 lower than the upstream resistance R3" is established, another condition of "a downstream current A1 higher than an upstream current A3" is naturally established. Here, the downstream current A1 is a current which is transmitted downstream of the nip inside the intermediate transfer belt 101, and then, flows in the drive roller 104. In contrast, the upstream current A3 is a current which is transmitted upstream of the nip inside the intermediate transfer belt 101, and then, flows in the tension roller 105.

In the copying machine in the present embodiment such configured as described above, it is possible to reduce the quantity of the upstream current A3 so as to suppress the unclearness at the edge of the full color secondary transfer image caused by the upstream current A3 in comparison with a copying machine in which "a downstream resistance R1 is higher than an upstream resistance R3", and accordingly, "a downstream current A1 is lower than an upstream current A3".

Next, a description will be given of a copying machine in a second embodiment, to which the present invention is applied. Incidentally, the basic constitution of the copying machine in the second embodiment is similar to that of the copying machine in the above-described first embodiment, and therefore, its explanation will be omitted here.

The copying machine in the second embodiment is configured such that the quantity of an upstream current A3 is maintained at 3.2 $\mu$A or lower irrespective of environmental fluctuations. There are two methods for maintaining the quantity of the upstream current A3 in this manner, as described below:

A first method is for combining the materials of a drive roller 104, a secondary transfer facing roller 103, a tension roller 105 and an intermediate transfer belt 101 so as to enable resistance varying characteristics to be exhibited in such a manner that the quantity of the upstream current A3 is securely maintained at 3.2 $\mu$A or lower under a predetermined condition. Such a predetermined condition is similar to that in the first embodiment.

Figure 3:
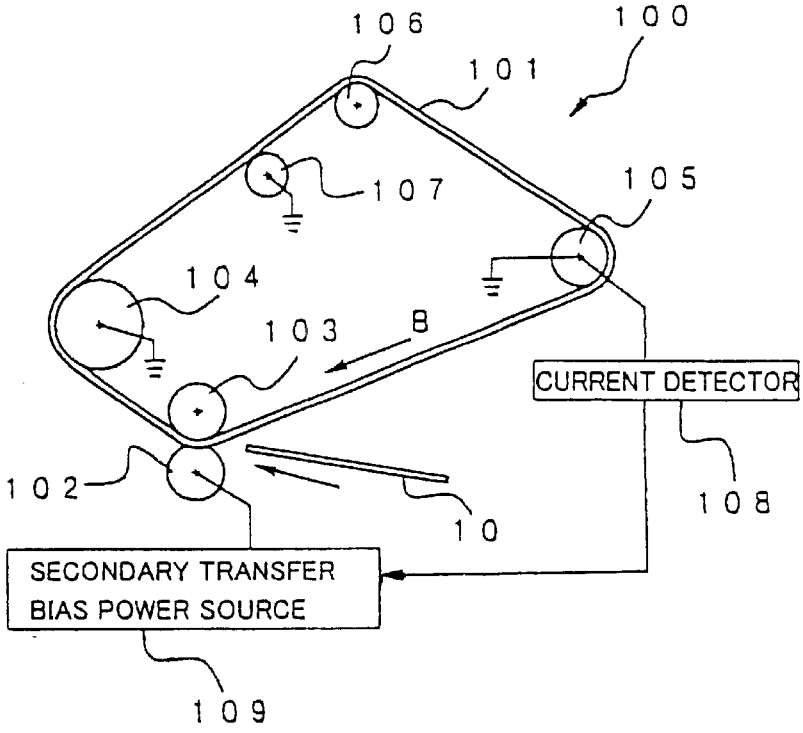
FIG. 3 is a view showing the constitution of essential parts in one example of a copying machine in a second embodiment.
Figure 4:
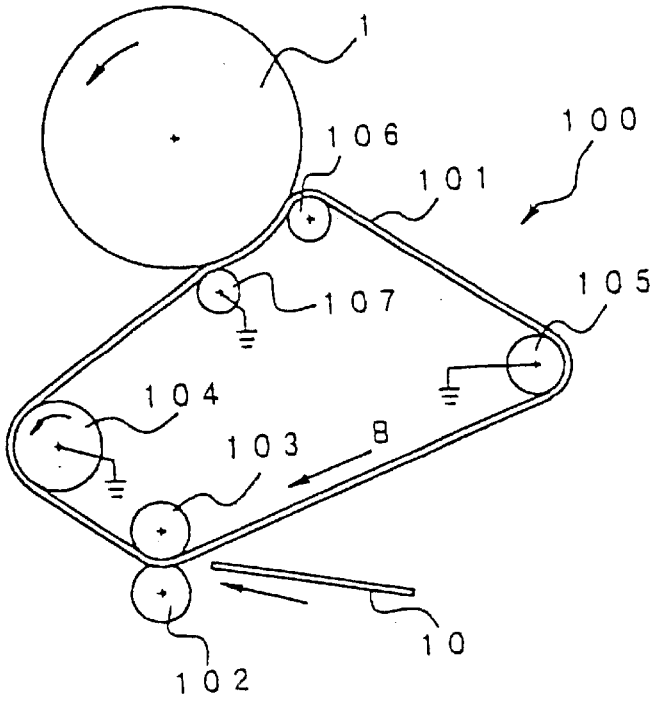
FIG. 4 is a schematic view showing the constitution of a conventional transfer device together with a photosensitive drum in an image forming apparatus.
Figure 5:
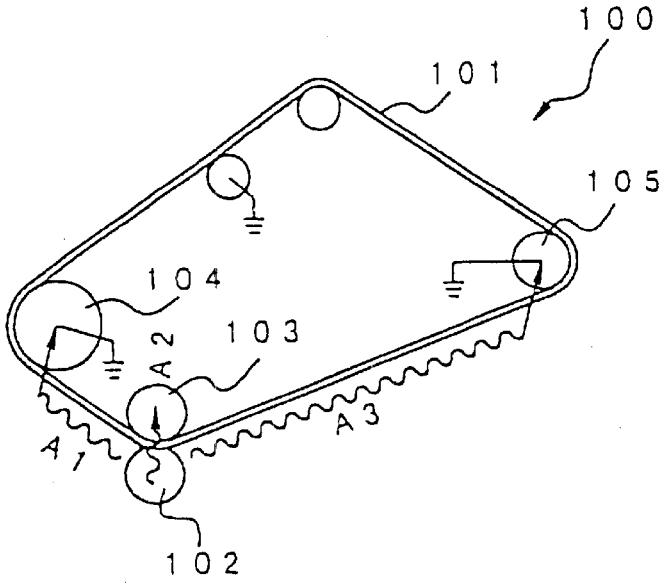
FIG. 5 is a schematic view illustrating a downstream current A1, a nip current A2 and an upstream current A3.
Figure 6:
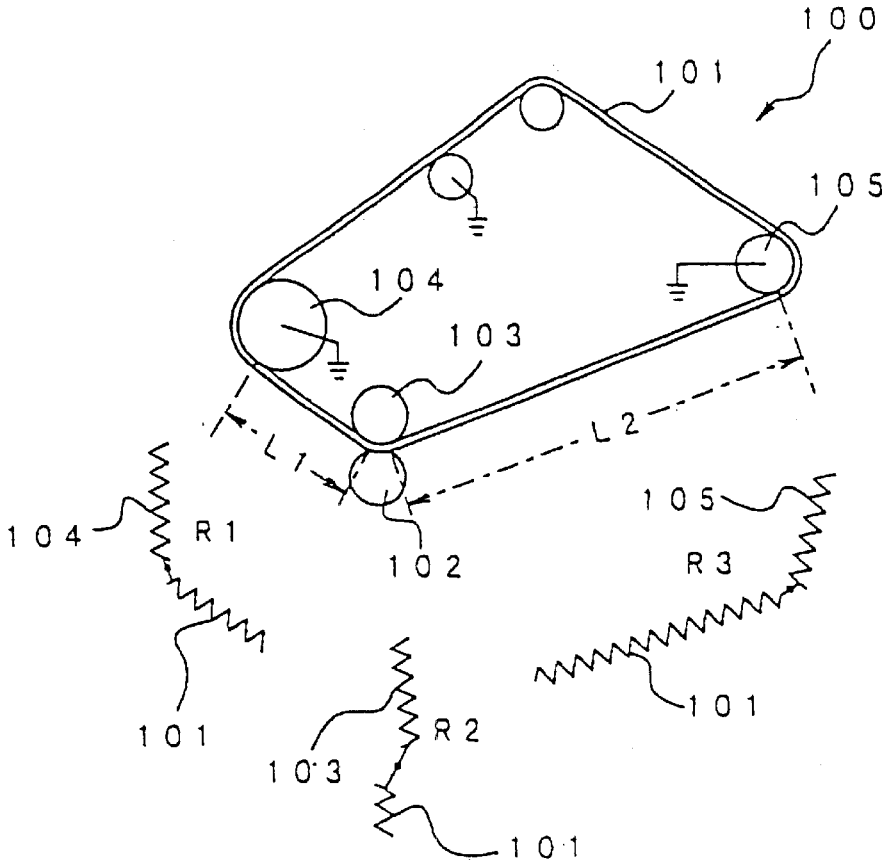
FIG. 6 is a schematic view illustrating a downstream resistance R1, a nip resistance R2 and an upstream resistance R3.

A second method is for allowing a secondary transfer bias power source to perform an output control in such a manner as to maintain the upstream current A3 at 3.2 $\mu$A or lower. FIG. 3 is a view illustrating the constitution of essential parts of the copying machine, in which the second method is adopted. In FIG. 3, a transfer device 100 is provided with a current detector 108 for detecting the value of the upstream current A3 which flows from an intermediate transfer belt 101 into a tension roller 105. The current value detected by the current detector 108 is converted into a predetermined electric signal, and then, the electric signal indicating the current value is sent to a secondary transfer bias power source 109. The secondary transfer bias power source 108 for supplying a secondary transfer bias to a secondary transfer bias roller 102 performs a constant-current control so as to vary an output voltage value in such a manner as to maintain the output current value with respect to the secondary transfer bias roller 102 at a predetermined value basically irrespective of environmental fluctuations. Here, in the case where the above-described current value signal from the current detector 108 is a signal indicating 3.2 $\mu$A, control is performed such that the output current value cannot be further increased even if the output current value is lower than the value to be maintained.

The copying machine in the second embodiment is configured such that the quantity of the upstream current A3 is maintained at 3.2 $\mu$A or lower irrespective of environmental fluctuations by the above-described first or second method. Therefore, as already illustrated in Table 1, toner dispersion caused by the upstream current A3 can be suppressed irrespective of the environmental fluctuations to such a level as not to be visually recognized. Incidentally, in the case where the above-described second method is adopted, the quantity of the upstream current A3 can be maintained at 3.2 $\mu$A or lower irrespective of the environmental fluctuations even unless the respective resistance varying characteristics of the drive roller 104, secondary transfer facing roller 103, tension roller 105 and intermediate transfer belt 101 are finely adjusted.

Although the copying machines in the embodiments have been described above, the embodiments according to the present invention cannot be limited to the above-described copying machines.

It is to be understood that the present invention can be applied to, for example, an image forming apparatus which is provided with a single developer, for forming a monochromatic image on a transfer member such as a transfer sheet.

Furthermore, the present invention can be applied to, for example, an image forming apparatus in which a secondary transfer bias roller 103 and a secondary transfer bias roller are transposed with each other, so that a secondary transfer bias having the same polarity as that of a toner is applied to the reverse of an intermediate transfer belt.

Moreover, the present invention can be applied to, for example, an image forming apparatus in which no secondary transfer nip is formed, but a transfer position forming roller in place of a secondary transfer bias roller 103 is brought into contact with an intermediate transfer belt 101 at a position not facing to a secondary transfer bias roller 102, so as to form a secondary transfer position.

Additionally, the present invention can be applied to, for example, an image forming apparatus in which primary transferring from a visible image carrying belt such as a photosensitive belt onto a transfer member such as a transfer sheet is performed, but no secondary transferring is performed, or an image forming apparatus for performing tertiary transferring or more.

In addition, the present invention can be applied not only to the image forming apparatus for forming the image by the electrophotographic process, but also to an image forming apparatus of a direct recording system called a toner projection as disclosed in Japanese Patent Application Laid-Open No. 9-254430, in which a visible image is transferred onto a transfer member such as a transfer sheet from a belt such as an opposite electrode belt serving as a visible image carrying belt.

According to the present invention, it is possible to produce an excellent effect that the unclearness of the edge of the transfer image caused by the upstream current can be suppressed in comparison with the case where the downstream resistance is set to be equal to or higher than the upstream resistance.

According to the present invention, it is possible to produce an excellent effect that the unclearness of the edge of the transfer image caused by the upstream current can be suppressed to such a level as not to be visually recognized irrespective of the environmental fluctuations.

Particularly, according to the present invention, it is possible to produce an excellent effect that the unclearness of the edge of the transfer image caused by the upstream current can be suppressed to such a level as not to be visually recognized under the designated environmental condition.

In particular, according to the present invention, it is possible to produce an excellent effect that the unclearness of the edge of the transfer image caused by the upstream current can be suppressed to such a level as not to be visually recognized irrespective of the fluctuations in temperature or the fluctuations in humidity within a general function ensuring temperature range (from 10° C. to 40° C.) or a general function ensuring humidity range (from 15% to 80%) in the transfer device.

More particularly, according to the present invention, it is possible to produce an excellent effect that the unclearness of the edge of the transfer image caused by the upstream current can be suppressed to such a level as not to be visually recognized irrespective of the environmental fluctuations even unless the respective resistance varying characteristics of the visible image carrying belt, transfer position forming member and grounding members are finely adjusted.

According to the present invention, it is possible to produce an excellent effect that the unclearness of the edge of the transfer image caused by the upstream current can be suppressed in comparison with the case where the downstream resistance is equal to or higher than the upstream resistance inside of the transfer device, or the unclearness of the edge of the transfer image caused by the upstream current inside of the transfer device can be suppressed to such a level as not to be visually recognized irrespective of the environmental fluctuations.

The present document incorporates by reference the entire contents of Japanese priority document, 2000-207748 filed in Japan on Jul. 10, 2000.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A transfer device comprising:

a visible image carrying belt carrying a visible image thereon and traveling in a predetermined direction;

a transfer current applying member which applies a transfer current in contact with the visible image carrying belt;

a transfer position forming member in contact with a surface of the visible image carrying belt on a side opposite to the surface in contact with the transfer current applying member, for introducing a transfer current in a direction of the thickness of the visible image carrying belt so as to form a transfer position between the transfer current applying member and the same;

a downstream grounding member disposed in such a manner as to be brought into contact with the visible image carrying belt downstream of the transfer position in the predetermined direction, to be thus electrically grounded; and an upstream grounding member disposed in such a manner as to be brought into contact with the visible image carrying belt upstream of the transfer position in the predetermined direction, to be thus electrically grounded, a visible image on the visible image carrying belt being transferred onto a transfer member to be fed to the transfer position, wherein a downstream resistance equivalent to the sum of an electric resistance over a length from a contact position with the transfer current applying member to a contact position with the downstream grounding member on the visible image carrying belt and an electric resistance of the downstream grounding member is set to be lower than an upstream resistance equivalent to the sum of an electric resistance over a length from the contact position with the transfer current applying member to a contact position with the upstream grounding member on the visible image carrying belt and an electric resistance of the downstream grounding member irrespective of environmental fluctuations.

2. A transfer device comprising:

a visible image carrying belt carrying a visible image thereon and traveling in a predetermined direction;

a transfer current applying member which applies a transfer current in contact with the visible image carrying belt;

a transfer position forming member in contact with a surface of the visible image carrying belt on a side opposite to the surface in contact with the transfer current applying member, for introducing a transfer current in a direction of the thickness of the visible image carrying belt so as to form a transfer position between the transfer current applying member and the same; and grounding members in contact with the visible image carrying belt at positions different from that of the transfer position forming member, to be thus electrically grounded, a visible image on the visible image carrying belt being transferred onto a transfer member to be fed to the transfer position, wherein the quantity of a current flowing upstream of the transfer position in the predetermined direction on the visible image carrying belt with the application of the transfer current is maintained at 3.2 $\mu$A or lower irrespective of environmental fluctuations.

3. A transfer device according to claim 2, wherein environmental conditions suitable for use are designated, and the visible image carrying belt, the transfer position forming member and the grounding members each are composed of a material capable of exhibiting resistance varying characteristics in such a manner as to maintain the quantity of the current at 3.2 $\mu$A or lower as long as the transfer device is used under the environmental conditions.

4. A transfer device according to claim 2, wherein the visible image carrying belt, the transfer position forming member and the grounding members each are composed of a material capable of exhibiting resistance varying characteristics in such a manner as to maintain the quantity of the current at 3.2 $\mu$A or lower within a temperature range from 10° C. or higher to 40° C. or lower irrespective of temperature fluctuations, or within a humidity range from 15% or more to 80% or less irrespective of humidity fluctuations.

5. A transfer device according to claim 2, wherein there are provided a transfer power source for supplying the transfer current to the transfer current applying member and current detecting means for detecting the quantity of the current, and the transfer power source is configured such that an output current is controlled in such a manner that the quantity of the current detected by the current detecting means becomes 3.2 $\mu$A or lower.

6. An image forming apparatus comprising:

visible image forming means for forming a visible image on a visible image carrying belt; and a transfer device for transferring the visible image from the visible image carrying belt onto a transfer member, an image being formed by transferring the visible image onto the transfer member, wherein the transfer device comprises a visible image carrying belt carrying a visible image thereon and traveling in a predetermined direction;

a transfer current applying member which applies a transfer current in contact with the visible image carrying belt;

a transfer position forming member in contact with a surface of the visible image carrying belt on a side opposite to the surface in contact with the transfer current applying member, for introducing a transfer current in a direction of the thickness of the visible image carrying belt so as to form a transfer position between the transfer current applying member and the same;

a downstream grounding member disposed in such a manner as to be brought into contact with the visible image carrying belt downstream of the transfer position in the predetermined direction, to be thus electrically grounded; and an upstream grounding member disposed in such a manner as to be brought into contact with the visible image carrying belt upstream of the transfer position in the predetermined direction, to be thus electrically grounded, a visible image on the visible image carrying belt being transferred onto a transfer member to be fed to the transfer position, wherein a downstream resistance equivalent to the sum of an electric resistance over a length from a contact position with the transfer current applying member to a contact position with the downstream grounding member on the visible image carrying belt and an electric resistance of the downstream grounding member is set to be lower than an upstream resistance equivalent to the sum of an electric resistance over a length from the contact position with the transfer current applying member to a contact position with the upstream grounding member on the visible image carrying belt and an electric resistance of the downstream grounding member irrespective of environmental fluctuations.

7. An image forming apparatus comprising:

visible image forming means for forming a visible image on a visible image carrying belt; and a transfer device for transferring the visible image from the visible image carrying belt onto a transfer member, an image being formed by transferring the visible image onto the transfer member, wherein the transfer device comprises a visible image carrying belt carrying a visible image thereon and traveling in a predetermined direction;

a transfer current applying member which applies a transfer current in contact with the visible image carrying belt;

a transfer position forming member in contact with a surface of the visible image carrying belt on a side opposite to the surface in contact with the transfer current applying member, for introducing a transfer current in a direction of the thickness of the visible image carrying belt so as to form a transfer position between the transfer current applying member and the same; and grounding members in contact with the visible image carrying belt at positions different from that of the transfer position forming member, to be thus electrically grounded, a visible image on the visible image carrying belt being transferred onto a transfer member to be fed to the transfer position, wherein the quantity of a current flowing upstream of the transfer position in the predetermined direction on the visible image carrying belt with the application of the transfer current is maintained at 3.2 $\mu$A or lower irrespective of environmental fluctuations.

8. An image forming apparatus according to claim 7, wherein environmental conditions suitable for use are designated, and the visible image carrying belt, the transfer position forming member and the grounding members each are composed of a material capable of exhibiting resistance varying characteristics in such a manner as to maintain the quantity of the current at 3.2 $\mu$A or lower as long as the transfer device is used under the environmental conditions.

9. An image forming apparatus according to claim 7, wherein the visible image carrying belt, the transfer position forming member and the grounding members each are composed of a material capable of exhibiting resistance varying characteristics in such a manner as to maintain the quantity of the current at 3.2 $\mu$A or lower within a temperature range from 10° C. or higher to 40° C. or lower irrespective of temperature fluctuations, or within a humidity range from 15% or more to 80% or less irrespective of humidity fluctuations.

10. An image forming apparatus according to claim 7, wherein there are provided a transfer power source for supplying the transfer current to the transfer current applying member and current detecting means for detecting the quantity of the current, and the transfer power source is configured such that an output current is controlled in such a manner that the quantity of the current detected by the current detecting means becomes 3.2 $\mu$A or lower.

* * * * *